US011603702B2

(12) United States Patent
Smith, Jr. et al.

(10) Patent No.: US 11,603,702 B2
(45) Date of Patent: Mar. 14, 2023

(54) WIND-DRIVEN ENVIRONMENTAL ELEMENT OPERABLE LOUVER

(71) Applicant: Air Distribution Technologies IP, LLC, Milwaukee, WI (US)

(72) Inventors: Dino Smith, Jr., Belton, MO (US); Melissa M. Massar, Lee's Summit, MO (US); Cody C. Thompson, Overland Park, KS (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 0 days.

(21) Appl. No.: 17/015,982

(22) Filed: Sep. 9, 2020

(65) Prior Publication Data

US 2021/0172244 A1 Jun. 10, 2021

Related U.S. Application Data

(60) Provisional application No. 62/946,251, filed on Dec. 10, 2019.

(51) Int. Cl.

| | |
|---|---|
| ***E06B 7/098*** | (2006.01) |
| ***E05F 1/00*** | (2006.01) |
| *F24F 13/15* | (2006.01) |

(52) U.S. Cl.

CPC ..... *E06B 7/098* (2013.01); *E05F 1/004* (2013.01); *F24F 13/15* (2013.01)

(58) Field of Classification Search

CPC ..... E06B 7/098; E06B 7/084; E06B 7/086; E05F 1/004

See application file for complete search history.

(56) References Cited

U.S. PATENT DOCUMENTS 2,527,989 A * 10/1950 Fuller ..... E05F 1/004 49/23
4,038,781 A * 8/1977 Graham ..... E06B 7/084 49/91.1

(Continued)

FOREIGN PATENT DOCUMENTS

CN 107420011 A * 12/2017 ..... E06B 7/086
CN 206874190 U * 1/2018

(Continued)

OTHER PUBLICATIONS

CN206874190U machine translation.*

*Primary Examiner* — Marcus Menezes
(74) *Attorney, Agent, or Firm* — Fletcher Yoder, P.C.

(57) ABSTRACT

Described is a louver having a frame that forms an enclosure defining an opening, and a plurality of louver blades disposed within the opening. Each of the plurality of louver blades include a catch member that longitudinally extends between a first blade end and a second blade end of a corresponding louver blade. The louver may also include a rotation assembly configured to rotatably couple with the plurality of louver blades and the frame. The plurality of louver blades may autonomously rotate about rotation members of the rotation assembly based on environmental elements captured in the catch member such that the plurality of louver blades are configured in an open position in response to no water in the catch member and are configured in a closed position in response to an amount of environmental elements in the catch member.

26 Claims, 7 Drawing Sheets

(56) References Cited

U.S. PATENT DOCUMENTS

| | | | | | |
|---|---|---|---|---|---|
| 4,064,670 | A * | 12/1977 | Lichtenwald | E06B 7/082 | 52/473 |
| 5,048,253 | A * | 9/1991 | Olsen | F24F 13/15 | 52/473 |
| 5,267,414 | A * | 12/1993 | Vaida | E06B 7/086 | 49/50 |
| 5,732,507 | A * | 3/1998 | Edwards | E04B 7/163 | 49/74.1 |
| 5,822,933 | A * | 10/1998 | Burroughs | E04B 1/7046 | 52/209 |
| 8,881,455 | B2 * | 11/2014 | Ro | E06B 7/086 | 49/7 |
| 9,022,019 | B2 * | 5/2015 | Jeronimo Lopes | H02S 40/44 | 126/569 |
| 9,650,786 | B2 * | 5/2017 | Weaver | E04B 7/163 | |
| 10,988,936 | B2 * | 4/2021 | Soetanto | E06B 7/082 | |
| 11,091,914 | B2 * | 8/2021 | Shan | E04D 13/064 | |
| 2004/0148899 | A1 * | 8/2004 | Fertile | E06B 7/086 | 52/581 |
| 2006/0179721 | A1 * | 8/2006 | Tan | E06B 7/084 | 49/403 |
| 2006/0272214 | A1 * | 12/2006 | Simonelli | E06B 7/086 | 49/92.1 |
| 2010/0199562 | A1 * | 8/2010 | Yang | E06B 7/086 | 49/92.1 |
| 2011/0099906 | A1 * | 5/2011 | Marocco | E06B 7/098 | 49/91.1 |
| 2013/0199736 | A1 * | 8/2013 | Ro | E06B 7/086 | 160/7 |
| 2014/0259932 | A1 * | 9/2014 | Stafford | E06B 7/084 | 49/92.1 |
| 2014/0260011 | A1 * | 9/2014 | Pettibone | E06B 7/26 | 52/209 |
| 2015/0251027 | A1 * | 9/2015 | Ro | A62C 2/14 | 160/7 |
| 2016/0115688 | A1 * | 4/2016 | Weaver | F24F 13/15 | 52/473 |
| 2017/0130454 | A1 * | 5/2017 | Krass | E04F 10/10 | |
| 2019/0234136 | A1 * | 8/2019 | Lu | E06B 7/28 | |
| 2020/0370781 | A1 * | 11/2020 | Rockhold | F24F 13/08 | |

FOREIGN PATENT DOCUMENTS

| | | | | |
|---|---|---|---|---|
| CN | 206874190 | U | 1/2018 | |
| FR | 2676079 | A1 * | 11/1992 | E04D 13/0354 |
| KR | 20120127124 | A | 11/2012 | |
| KR | 20130107988 | A * | 10/2013 | |
| WO | WO-2004013544 | A1 * | 2/2004 | F24F 13/082 |

* cited by examiner

WIND-DRIVEN ENVIRONMENTAL ELEMENT OPERABLE LOUVER

CROSS-REFERENCE TO RELATED APPLICATION

This application claims the benefit of U.S. Provisional Application Ser. No. 62/946,251, entitled "WIND-DRIVEN RAIN OPERABLE LOUVER" and filed on Dec. 10, 2019, which is expressly incorporated by reference herein in its entirety.

BACKGROUND

Louvers are used to prevent ingress of wind, rain, leaves, insects and other foreign materials into a heating, ventilation, and air conditioning (HVAC) system. Existing louvers may not provide sufficient protection against wind-driven environmental elements.

Thus, improvements in louvers are desired.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

The present disclosure relates to a louver that may provide improved self-draining of environmental elements. In an aspect, a louver is disclosed. The louver may include a frame that forms an enclosure defining an opening. The louver may also include a first louver blade disposed within the opening, wherein the first louver blade includes a catch member that longitudinally extends between a first blade end and a second blade end of the first louver blade. The louver may also include a first rotation member rotatably coupling the first louver blade with the frame at the first blade end and the second blade end, wherein the first louver blade autonomously rotates about the first rotation member based on environmental elements captured in the catch member such that the first louver blade is configured in a fully open position in response to no environmental elements in the catch member and is configured in a fully closed position in response to a threshold amount of environmental elements in the catch member.

In another aspect a louver is disclosed. The louver may include a frame that forms an enclosure defining an opening. The louver may also include a first louver blade disposed within the opening, wherein the first louver blade includes a catch member that longitudinally extends between a first blade end of the first louver blade and a second blade end of the first louver blade. The louver may also include a drain channel coupled with a jamb of the frame and configured to receive environmental elements from the catch member of the first louver blade, wherein the first louver blade autonomously rotates about a longitudinal axis based on the environmental elements captured in the catch member such that the first louver blade is configured in a fully open position in response to no environmental elements in the catch member and is configured in a fully closed position in response to a threshold amount of the environmental elements in the catch member.

These and other features of the louver of the present disclosure are described in more detail below.

BRIEF DESCRIPTION OF THE DRAWINGS

The features believed to be characteristic of aspects of the disclosure are set forth in the appended claims. In the description that follows, like parts are marked throughout the specification and drawings with the same numerals. The drawing figures are not necessarily drawn to scale and certain figures may be shown in exaggerated or generalized form in the interest of clarity and conciseness. The disclosure itself, however, as well as a preferred mode of use and further advantages thereof, will be best understood by reference to the following detailed description of illustrative aspects of the disclosure when read in conjunction with the accompanying drawings, wherein:

DETAILED DESCRIPTION

Figure 1:
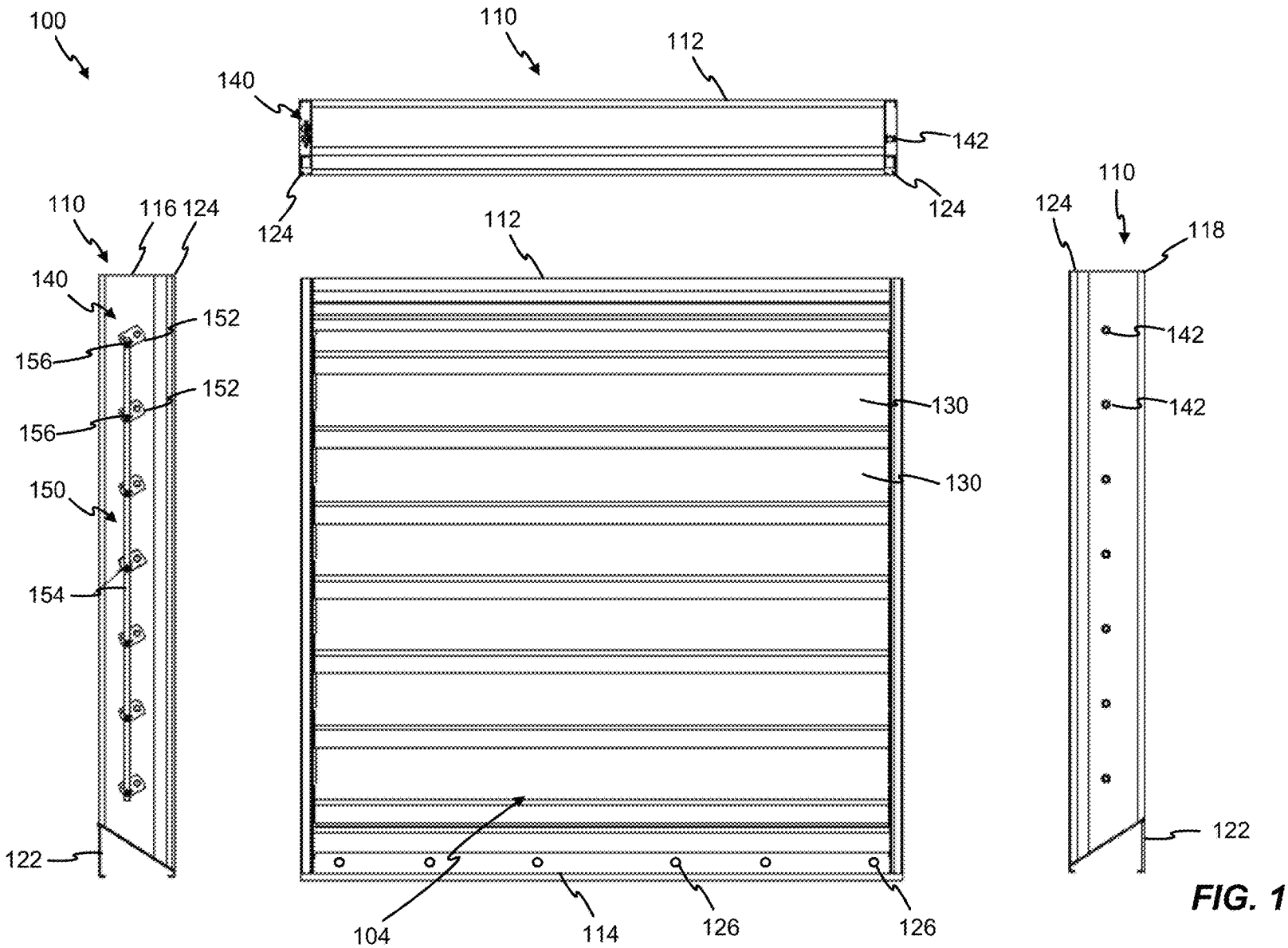
FIG. 1 is plan views of an example of the disclosed louver, including front plan view, top plan view, and side plan views of the louver, according to aspects of the present disclosure.
Figure 2:
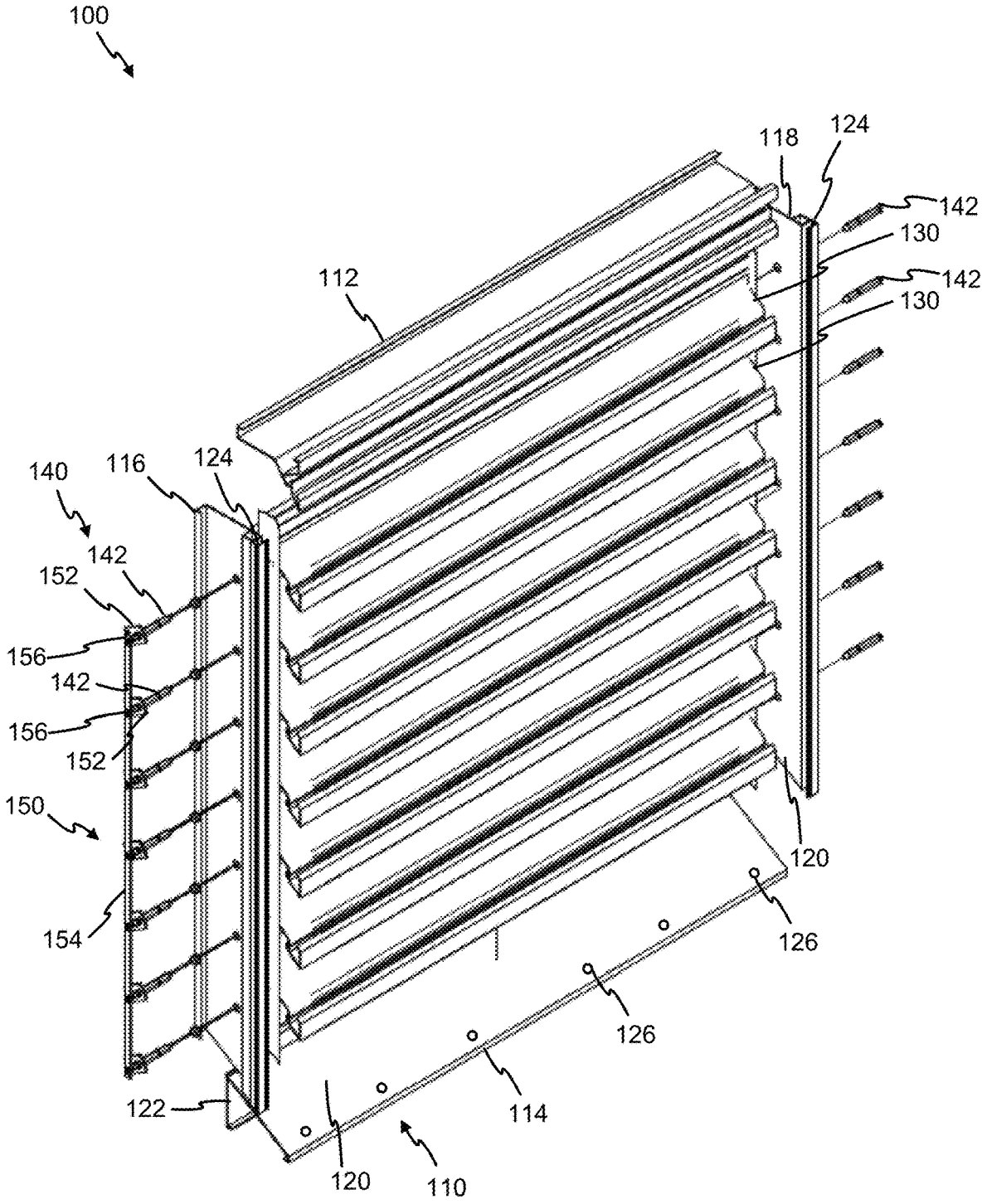
FIG. 2 is an exploded perspective view of the louver of FIG. 1.
Figure 3:
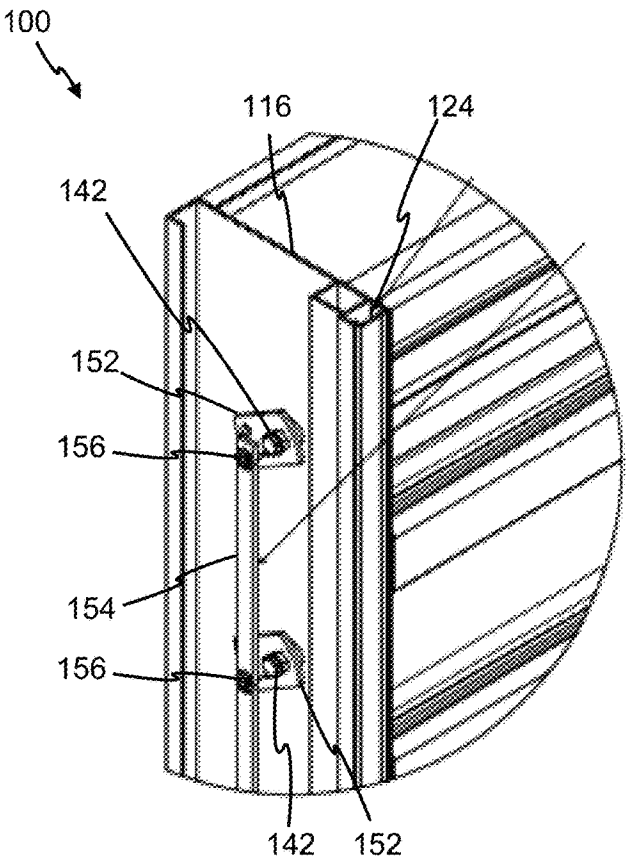
FIG. 3 is a partial side view of the louver of FIG. 1.
Figure 4:
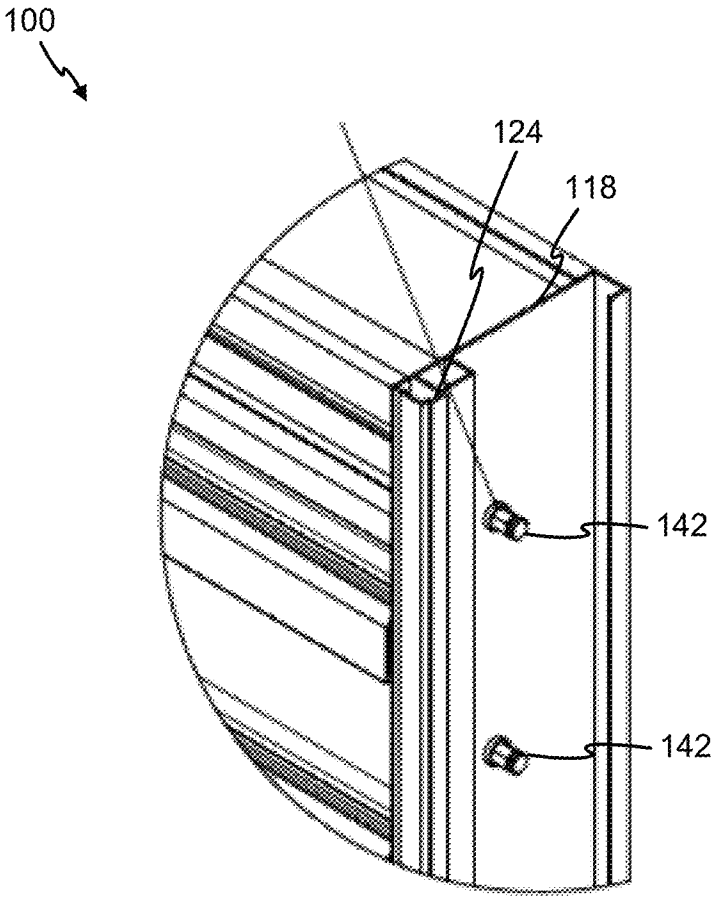
FIG. 4 is another partial side view of the louver of FIG. 1.
Figure 5:
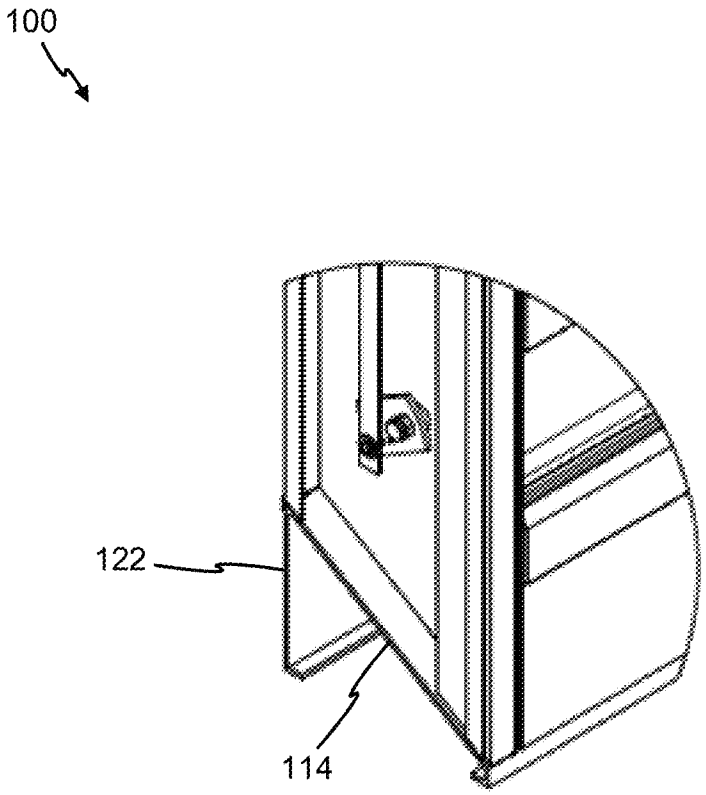
FIG. 5 is a partial side bottom view of the louver of FIG. 1.

The present disclosure relates to a louver having improved wind-driven environmental elements resistance. In particular, the disclosed louver provides a wind-driven environmental elements louver where blades on the louver are opened or closed based on an amount of environmental elements the blades accumulate, while maintaining a high air flow area in an opened position. The environmental elements may include, for example, liquid, such as rain or water, dirt, sand, or debris. In particular, the louver includes self-closing blades that close due to accumulation of the environmental elements (e.g., water from rain or from moisture in the air). In an example, the blades may be drainable such that the blades may open when accumulated environmental elements held by the blades has subsided, e.g., exited out. The louver may also include drainable jambs that allow the accumulated environmental elements in the blades to exit out of the louver. The blades may remain in a fully open position when no environmental elements or a minimal amount of environmental elements is accumulated and close to a fully closed position when filled with a threshold amount of environmental elements. Further, the blades may rotate between a plurality of positions that range between the fully open position and fully closed position, with the degree of open/closed varying depending on an amount of accumulated environmental elements in the blades.

The louver is also configured to let air flow in the open position while minimizing the chance of the environmental elements entering an air handling unit and/or a building through the blades by variably moving to the closed position based on the amount of accumulated environmental elements. When the blades are holding a threshold capacity of environmental elements, the blades may close to the fully closed position thereby minimizing or eliminating air flow. As compared to the fully open position, the movement of the louver blades towards or up to the fully closed position may increase the effectiveness of the louver in preventing environmental elements (e.g., water and/or moist air) from entering an attached air handling unit and/or building.

These and other features of the disclosed louver will be discussed in more detail below.

Referring to FIGS. 1-7, an example louver 100 is configured for improved resistance to wind-driven environmental elements. The louver 100 may include a frame 110 having a plurality of frame sections, such as frame sections 112-118, which form an enclosure of the louver 100 and define an inner air passage area 104 (or opening). The inner air passage area 104 may include a space defined by inner surfaces 120 of the frame sections 112-118 through which air may pass from a face (or front or forward) side of the louver 100 to a back (or rear or aft) side of the louver 100. In some cases, the frame section 112 may be referred to as a head or top frame, the frame section 114 may be referred to as a sill frame, and the frame sections 116 and 118 may be referred to as jamb frames.

The frame section 114 may be sloped towards the face side of the louver 100 to allow liquids (e.g., water) to drain towards the face side. In an example, a back support 122 may be positioned under the back side of the frame section 114 to raise and/or support the back side of the frame section 114 to be positioned higher than a front side of the frame section 114. In an example, the frame section 114 may also include one or more weep holes 126 positioned to allow the liquids to drain off the frame section 114.

Additionally, the louver 100 may include a plurality of louver blades 130 positioned within at least the inner air passage area 104 and configured to autonomously rotate between an open position and a closed position based on an amount of captured environmental elements. The louver blades 130 may catch the environmental elements carried by the air and carry the environmental elements to frame section 114 at a base of the louver 100, thereby minimizing or preventing passage of the environmental elements through the louver 100.

The frame sections 116 and 118 may each include a drain channel 124 positioned at the face of the louver 100. The drain channel 124 is configured to receive the environmental elements from the plurality of louver blades 130 and provide a channel for the environmental elements to run to the frame section 114. In an example, the drain channel 124 may be an area recessed from the inner surfaces of the frame sections 116, 118.

The plurality of louver blades 130 may be rotatably mounted to one or more of the frame sections 116 and 118 by a rotation assembly 140. In an example, the rotation assembly 140 may include a plurality of rotation members 142 which contact the plurality of louver blades 130. In an implementation, the rotation members 142 may provide the sole support for the plurality of louver blades 130 within the frame 110. In other words, the rotation members 142 may be the only connection or contact point between the plurality of louver blades 130 and the frame 110.

In some aspects, the rotation assembly 140 may also include a linkage assembly 150 which is configured to rotate the plurality of louver blades 130 simultaneously. The linkage assembly 150 may include a plurality of link members 152 that fixedly couple with the rotation members 142. The linkage assembly 150 may also include a linkage bar 154 configured to rotatably connect with the plurality of link members 152. In an example, the linkage bar 154 may couple with each of the plurality of link members 152 through rotation pins 156.

The frame 110, the rotation assembly 140, and the plurality of louver blades 130 may be formed from a substantially rigid material, such as a metal, a ceramic, a composite material, or any other material suitable for wind-driven environmental elements resistance.

Figure 6:
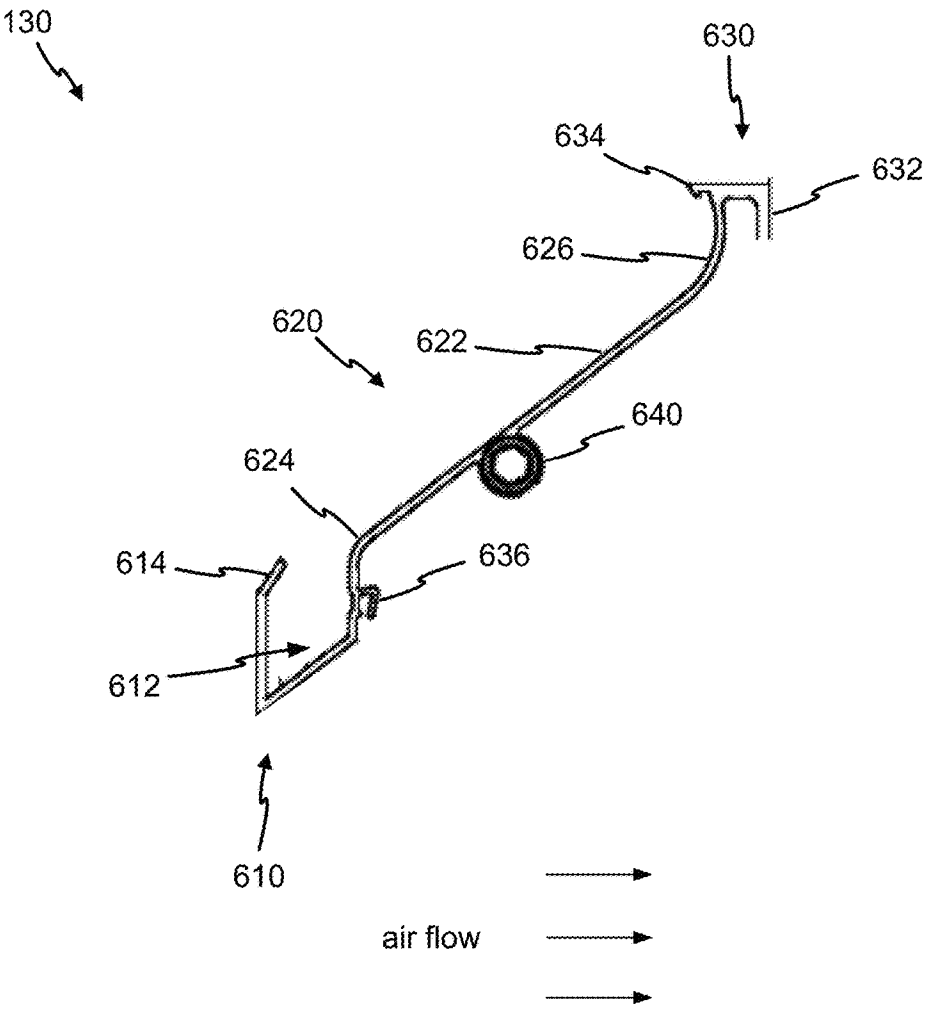
FIG. 6 is a side view of an example louver blade of the louver of FIG. 1.

Referring specifically to FIG. 6, each of the plurality of louver blades 130 may have a shape and/or one or more structures to capture the environmental elements and to allow air to flow through the louver 100 in both an open position and a closed position. In an aspect, the louver blade 130 may include a catch member 610 that extends a length of the louver blade 130. The catch member 610 may include one or more walls at a lower end that form a channel 612 configured to hold captured environmental elements and allows the environmental elements to exit the catch member 610 at first and second blade ends of the louver 100, near the frame sections 116 and 118. For example, in an implementation, the channel 612 may be substantially horizontal, but the force of the incoming air flow may push the accumulated environmental elements toward the ends to drain the environmental elements. In an aspect, the catch member 610 may also include a lip 614 configured to prevent the captured environmental elements from overflowing a face of the catch member 610. For example, in an implementation, the lip 614 may be angled toward the channel 612, relative to other wall structures defining the channel 612, wherein the angle effectively increases a height of the channel 612 as the louver blade 130 rotates from an open position to a closed position. For instance, in the closed position, one example configuration of the lip 614 may have a substantially vertical orientation, although other orientations may be utilized.

In an aspect, the louver blade 130 may also include a body that is formed in the shape of backwards "S." For example, the body 620 may include a face surface 622 at a face of the louver blade 130 that provides a slope for the environmental elements to move towards the catch member 610. The body 620 may also include a first curved portion 624 that curves away from the face of the louver 100 and connects to the catch member 610, thereby allowing the environmental elements to run into the catch member 610. The body 620 may also include a second curved portion 626 that curves towards the face of the louver 100.

In an aspect, the louver blade 130 may also include a first end member 630 coupled with the body 620 at the second curved portion 626. The first end member 630 may include a balance member 632 configured to counter balance the weight of the catch member 610 so the louver blade 130 may rotate to an open position when environmental elements are drained from the catch member 610 and to a closed position when the catch member 610 is completely filled with the environmental elements.

In an aspect, the louver blade 130 may also include a first contact portion 634 and a second contact portion 636 configured for providing a contact surface for the louver blade 130 when in the closed position. The first contact portion 634 may be positioned on a face of the louver blade 130 such that when the louver blade 130 rotates to the closed position, the first contact portion 634 contacts a contact portion of another louver blade 130 (e.g., second contact portion 636 of another louver blade 130) or a part of the frame 110 (such as the frame section 112). In an example, the first contact portion 634 and the second contact portion 636 may extend longitudinally along the louver blade 130 such that when in contact with each other, the first contact portion 634 and the second contact portion 636 contact along the entire length of the louver blade 130 and prevent airflow through the louver 100 in the closed position. In another example, the first contact portion 634 or the second contact portion 636 may include one or more contact points such that when in contact with each other, the first contact portion 634 and the second contact portion 636 form passages for the air to flow through the louver 100 in the closed position.

In an aspect, the louver blade 130 may also include a rotational nut 640 coupled with the body 620 of the louver blade 130. The rotational nut 640 may be formed to receive the rotation member 142. In an example, the rotational nut 640 may form an aperture that corresponds to a shape of the rotation member 142 to fixedly connect the louver blade 130 to the rotation member 142. For example, the rotational nut 640 may form an aperture shaped into a hexagon, as shown by FIG. 6, which corresponds to a hexagon shape of the rotation member 142.

While the louver blade 130 is described as having separate members and/or portions, one skilled in the art would recognized that the louver blade 130 may be formed of a single piece of material (e.g., metal, composite material) or a plurality of formed pieces of material that are connected together.

Figure 7:
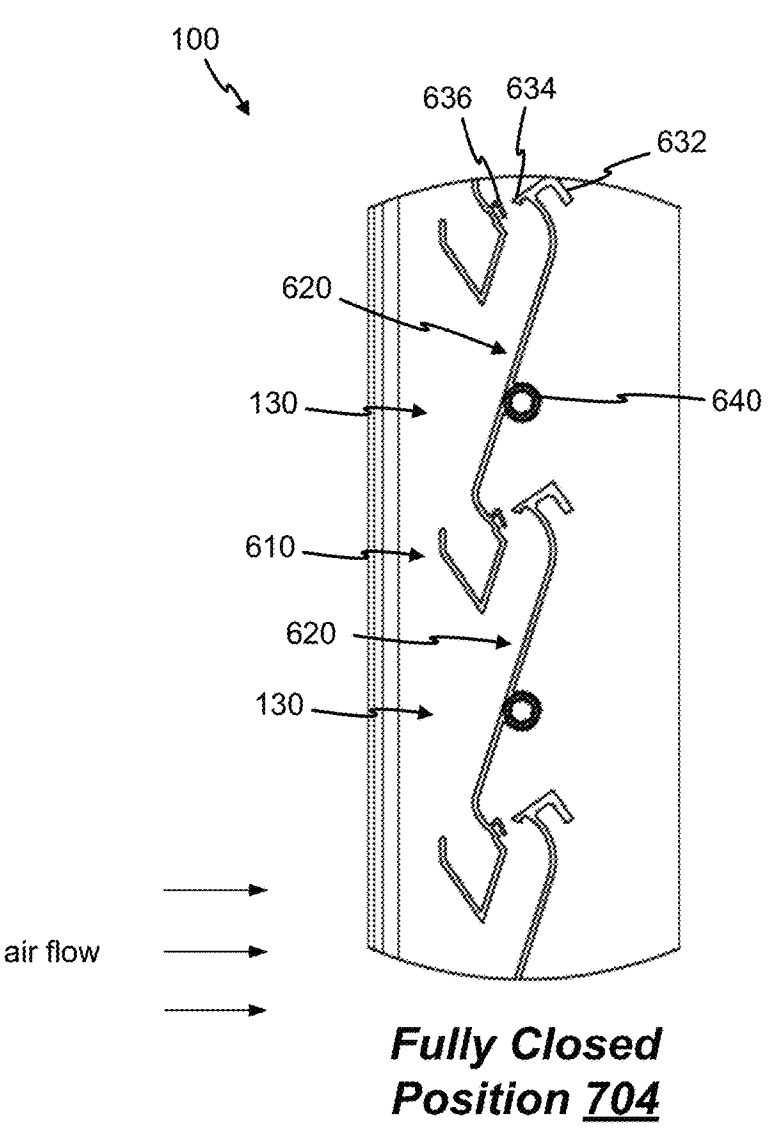
FIG. 7 are partial side views of the louver of FIG. 1 in open and closed positions.
Figure 7:
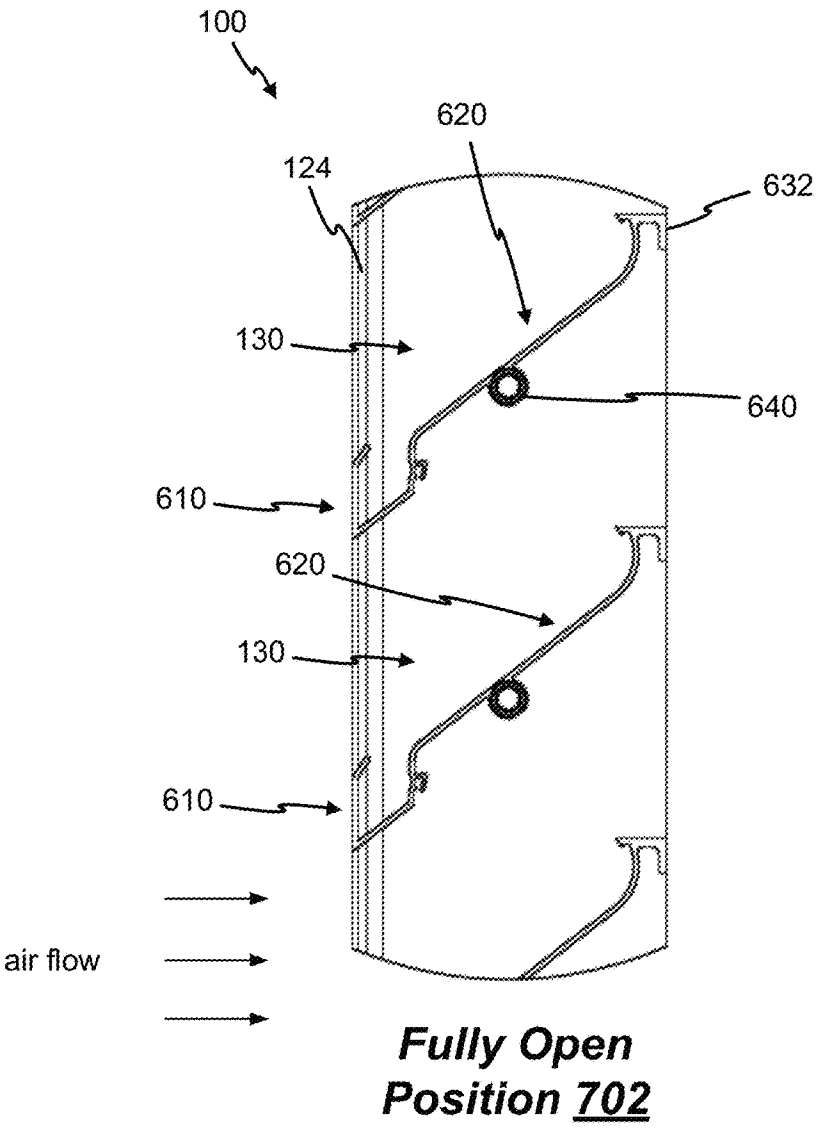

Referring to FIG. 7, the louver 100 may be variably movable between a fully open position 702 and a fully closed position 704, including a plurality of positions (not shown) in-between the fully open position 702 and fully closed position 704. These positions are dependent on an amount of accumulated environmental elements on each louver blade 130 and/or in each channel 612. For example, in the fully open position 702, the louver blades 130 may be positioned to allow a maximum amount of air to flow through the louver 100. In the fully open position 702, the face surface 622 of the louver blades 130 may be balanced about the rotational nut 640 at a sloped angle (e.g., 60-30 degrees) due to a weight of the balance member 632. In this position, the wind-driven environmental elements may partially enter the inner air passage area 104 of the louver 100 but may be blocked from passing through an entirety of the inner air passage area 104 of the louver 100 due to the backward "S" shape of the body 620. In particular, the wind-driven environmental elements may be blocked by the body 620 and run down the body 620 towards the catch member 610. The environmental elements may be received by the catch member 610 and drained from the catch member 610 at the blade ends via the drain channel 124 of the frame sections 116 and 118 to provide for a quick exit of the environmental elements from the louver 100.

As environmental elements accumulate in the catch member 610, for example, as an intensity of the rain increases, the louver blades 130 may rotate due to the weight of the accumulated environmental elements in the catch member 610 towards the fully closed position 704. In an example, an amount of environmental elements that accumulates in the catch member 610 may be proportional to an amount of rotation by the louver blades 130 about the rotational nut 640. In other words, as the amount of environmental elements in the catch member 610 increases, a weight of the catch member 610 increases thereby causing the louver blades 130 to rotate about the rotational nut 640. In another example, a threshold amount of environmental elements may accumulate in the catch member 610 before rotating about the rotational nut 640. For example, the environmental elements in the catch member 610 may remain in the fully open position 702 until a weight of the accumulated environmental elements in the catch member 610 reaches and/or exceeds a threshold weight amount (e.g., biasing force) equivalent to a weight of the balance member 632. Once the threshold weight is met or exceeded, the louver blades 130 may rotate about the rotational nut 640 towards the fully closed position 704.

In the fully closed position 704, the louver blades 130 may be rotated such that the environmental elements continues to be blocked from passing through the inner air passage area 104 and the airflow through the inner air passage area 104 is minimized. For example, in the fully closed position 704, the face surface 622 of the louver blades 130 may be at a sloped angle (e.g., 90-75 degrees) greater than the sloped angle of the louver blades while in the fully open position 702. In this position, the environmental elements may continue to be captured by running down the body 620 of the louver blades 130 and into the catch member 610. The environmental elements may then exit the louver blades 130 from the blade ends of the louver blades 130 by running down the inner surfaces 120 of the frame section 116 and 118. Finally, the environmental elements may be discarded from the louver 100 via the frame section 114.

Further, in the fully closed position 704, the louver blades 130 may be rotated such that the first contact portion 634 of a first louver blade 130 contacts the second contact portion 636 of a second louver blade 130 (or frame section 112), thereby reducing the airflow through the louver 100.

The louver blades 130 may return to the fully open position 702 from the fully closed position 704. For example, the louver blades 130 may rotate about the rotational nut 640 due to the weight of the accumulated environmental elements in the catch member 610 decreasing.

Example Implementations

As described above, the louver of the present disclosure may include any of a number of different features depending on the particular application or installation requirements. Examples of such different configurations include one or more of the following.

An example louver, comprising: a frame that forms an enclosure defining an opening; a first louver blade disposed within the opening, wherein the first louver blade includes a catch member that longitudinally extends between a first blade end and a second blade end of the first louver blade; and a first rotation member rotatably coupling the first louver blade with the frame at the first blade end and the second blade end, wherein the first louver blade autonomously rotates about the first rotation member based on environmental elements captured in the catch member such that the first louver blade is configured in a fully open position in response to no environmental elements in the catch member and is configured in a fully closed position in response to a threshold amount of environmental elements in the catch member.

The above example louver, further comprising: a drain channel coupled with a jamb of the frame and configured to receive environmental elements from the catch member of the first louver blade. One or more of the above example louvers, wherein the drain channel is positioned at a face of the frame.

One or more of the above example louvers, wherein the drain channel extends between a sill and a frame section of the frame opposite to the sill.

One or more of the above example louvers, wherein the catch member is formed to capture environmental elements running down a body of the first louver blade.

One or more of the above example louvers, wherein the first louver blade further includes a balance member positioned on a side opposite the catch member, wherein the balance member provides a counter-balance to environmental elements in the catch member.

One or more of the above example louvers, wherein the first louver blade further includes a blade body that extends along a first axis between the first blade end and the second blade end.

One or more of the above example louvers, wherein edges of the blade body are formed by the catch member and the balance member.

One or more of the above example louvers, wherein the blade body includes a flat portion and a first curved portion coupled with the catch member and a second curved portion coupled with the balance member.

One or more of the above example louvers, wherein the first curved portion is curved away from a face of the frame, and the second curved portion is curved towards the face of the frame.

One or more of the above example louvers, further comprising: a rotational nut coupled with the blade body, wherein the rotational nut is configured to receive the first rotation member.

One or more of the above example louvers, further comprising: a second louver blade disposed within the opening and rotatably coupled with the frame; and a linkage assembly fixedly coupled with the first rotation member of the first louver blade and a second rotation member of the second louver blade and configured to cause simultaneous rotation of the first louver blade and the second louver blade.

One or more of the above example louvers, wherein, in the fully closed position, a first contact portion of the first louver blade contacts a second contact portion of the second louver blade.

One or more of the above example louvers, wherein, in the fully closed position, the first contact portion of the first louver blade and the second contact portion of the second louver blade form a gap to allow air to pass between the first louver blade and the second louver blade.

One or more of the above example louvers, wherein the linkage assembly includes a first link member fixedly coupled with the first rotation member of first louver blade, a second link member fixedly coupled with the second rotation member of the second louver blade, and a linkage bar rotatably coupled to the first link member and the second link member.

One or more of the above example louvers, wherein the frame includes a sill sloped towards a face of the frame and configured to provide a path for environmental elements to exit the louver via the face of the frame.

One or more of the above example louvers, wherein the frame further includes a back support positioned a raised portion of the sill.

One or more of the above example louvers, further comprising: a drain channel coupled with a jamb of the frame and configured to receive environmental elements from the catch member of the first louver blade and provide a path for environmental elements to exit the drain channel at the sill.

One or more of the above example louvers, wherein the sill includes a weep hole configured to allow the environmental elements to drain from the frame.

One or more of the above example louvers, wherein the first rotation member includes a rotation pin fixedly coupled with the first louver blade and rotatably coupled with the frame.

One or more of the above example louvers, wherein the catch member includes a lip configured to prevent the environmental elements from overflowing a face of the catch member.

A second example louver, comprising: a frame that forms an enclosure defining an opening; a first louver blade disposed within the opening, wherein the first louver blade includes a catch member that longitudinally extends between a first blade end of the first louver blade and a second blade end of the first louver blade; a drain channel coupled with a jamb of the frame and configured to receive water from the catch member of the first louver blade, wherein the first louver blade autonomously rotates about a longitudinal axis based on the water captured in the catch member such that the first louver blade is configured in a fully open position in response to no environmental elements in the catch member and is configured in a fully closed position in response to a threshold amount of environmental elements in the catch member.

The second example louver above, wherein the first louver blade further includes a balance member positioned on a side opposite the catch member, wherein the balance member provides a counter-balance to an amount of environmental elements in the catch member.

One or more of the above second example louvers, wherein the first louver blade further includes a blade body that extends along the longitudinal axis between the first blade end and the second blade end, the blade body including a flat portion and a first curved portion curved away from a face of the frame and a second curved portion is curved towards the face of the frame.

One or more of the above second example louvers, further comprising: a first rotation member rotatably coupling the first louver blade with the frame; and a rotational nut fixedly coupled with the first louver blade, wherein the rotational nut is configured to receive the first rotation member.

It will be appreciated that various implementations of the above-disclosed and other features and functions, or alternatives or varieties thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A louver, comprising:

a frame that forms an enclosure defining an opening;

a first louver blade disposed within the opening, wherein the first louver blade includes a blade body and a catch member that longitudinally extend between a first blade end and a second blade end of the first louver blade, wherein the catch member comprises a first segment extending from the blade body, a second segment extending from the first segment, and a third segment extending from the second segment, and wherein the first segment, the second segment, and the third segment define a channel configured to capture one or more environmental elements, and the blade body is configured to direct the one or more environmental elements into the channel;

a first rotation member rotatably coupling the first louver blade with the frame; and a drain channel formed in an inner surface of the frame and defining a recess, wherein the first louver blade autonomously rotates about the first rotation member based on the one or more environmental elements captured in the channel such that the first louver blade is configured in a fully open position in response to no environmental elements in the channel and is configured in a fully closed position in response to a threshold amount of environmental elements in the channel, wherein the catch member is configured to direct the one or more environmental elements captured in the channel to the first blade end or to the second blade end and into the drain channel.

2. The louver of claim 1, wherein the drain channel is coupled with a jamb of the frame.

3. The louver of claim 2, wherein the drain channel extends between a sill and a frame section of the frame opposite to the sill.

4. The louver of claim 1, wherein the second segment is obliquely angled relative to the first segment, and wherein the third segment is obliquely angled relative to the second segment.

5. The louver of claim 1, wherein the first louver blade comprises a balance member positioned on a side opposite the catch member, wherein the balance member is configured to provide a counter-balance to the one or more environmental elements in the channel.

6. The louver of claim 5, wherein edges of the blade body are formed by the catch member and the balance member.

7. The louver of claim 1, wherein the blade body comprises a flat portion, a first curved portion extending from the flat portion to the first segment, and a second curved portion extending from the flat portion to a balance member positioned on a side of the blade body opposite the catch member, wherein the first curved portion is configured to direct the one or more environmental elements from the blade body into the channel of the catch member.

8. The louver of claim 7, wherein the first curved portion is curved away from a face of the frame, and the second curved portion is curved towards the face of the frame.

9. The louver of claim 1, further comprising:

a rotational nut coupled with the blade body, wherein the rotational nut is configured to receive the first rotation member.

10. The louver of claim 1, further comprising:

a second louver blade disposed within the opening and rotatably coupled with the frame; and a linkage assembly fixedly coupled with the first rotation member of the first louver blade and a second rotation member of the second louver blade and configured to cause simultaneous rotation of the first louver blade and the second louver blade.

11. The louver of claim 10, wherein a first contact portion of the first louver blade is configured to contact a second contact portion of the second louver blade in the fully closed position.

12. The louver of claim 11, wherein the first contact portion of the first louver blade or the second contact portion of the second louver blade comprises contact points configured to form passages between the first contact portion and the second contact portion to allow air to pass between the first louver blade and the second louver blade in the fully closed position.

13. The louver of claim 10, wherein the linkage assembly comprises a first link member fixedly coupled with the first rotation member of the first louver blade, a second link member fixedly coupled with the second rotation member of the second louver blade, and a linkage bar rotatably coupled to the first link member and the second link member.

14. The louver of claim 1, wherein the frame comprises a sill sloped towards a face of the frame, and wherein the frame is configured to provide a path for the one or more environmental elements to exit the louver via the face of the frame.

15. The louver of claim 14, wherein the frame comprises a back support positioned beneath a raised portion of the sill.

16. The louver of claim 14, wherein the drain channel is coupled with a jamb of the frame and is configured to direct the one or more environmental elements to exit the drain channel at the sill.

17. The louver of claim 14, wherein the sill comprises a weep hole configured to allow the one or more environmental elements to drain from the frame.

18. The louver of claim 1, wherein the first rotation member comprises a rotation pin fixedly coupled with the first louver blade and rotatably coupled with the frame.

19. The louver of claim 1, wherein the catch member comprises a lip extending from the third segment and configured to prevent the one or more environmental elements from overflowing a face of the catch member.

20. The louver of claim 1, wherein the first rotation member rotatably couples the first louver blade with the frame at the first blade end and the second blade end.

21. A louver, comprising:

a frame that forms an enclosure defining an opening;

a first louver blade disposed within the opening, wherein the first louver blade includes a blade body and a catch member that longitudinally extend between a first blade end of the first louver blade and a second blade end of the first louver blade, and the blade body includes a flat portion and a first curved portion, wherein the first curved portion is curved from the flat portion to the catch member; and a drain channel coupled with a jamb of the frame and configured to receive one or more environmental elements from the catch member of the first louver blade, wherein the first louver blade autonomously rotates about a longitudinal axis based on the one or more environmental elements captured in the catch member such that the first louver blade is configured in a fully open position in response to no environmental elements in the catch member and is configured in a fully closed position in response to a threshold amount of environmental elements in the catch member.

22. The louver of claim 21, wherein the first louver blade further includes a balance member positioned on a side of the blade body opposite the catch member, wherein the balance member provides a counter-balance to an amount of the one or more environmental elements in the catch member.

23. The louver of claim 21, wherein the first curved portion is curved away from a face of the frame, and a second curved portion extending from the flat portion is curved towards the face of the frame.

24. The louver of claim 21, further comprising:

a first rotation member rotatably coupling the first louver blade with the frame; and a rotational nut fixedly coupled with the first louver blade, wherein the rotational nut is configured to receive the first rotation member.

25. The louver of claim 21, wherein the catch member comprises a first segment extending from the first curved portion, a second segment extending from the first segment, and a third segment extending from the second segment, and wherein the catch member comprises a lip extending from the third segment and configured to block the one or more environment elements from overflowing a face of the catch member.

26. The louver of claim 25, wherein the catch member defines a channel configured to capture the one or more environmental elements, and wherein the lip is disposed on a side of the channel opposite the first segment.

* * * * *